US010952460B2

(12) United States Patent
Duignan et al.

(10) Patent No.: US 10,952,460 B2
(45) Date of Patent: Mar. 23, 2021

(54) COMPOSITION FOR A TOBACCO-FREE CHEW AND METHOD OF MANUFACTURING SAME

(71) Applicant: Blesst Boyz LLC, Akron, OH (US)

(72) Inventors: Alan J. Duignan, Uniontown, OH (US); Kenneth A. Dawson, Jr., Uniontown, OH (US); Michael R. Crawford, Akron, OH (US); Sean P. Linton, Akron, OH (US)

(73) Assignee: Blesst Boyz LLC, Akron, OH (US)

( * ) Notice: Subject to any disclaimer, the term of this patent is extended or adjusted under 35 U.S.C. 154(b) by 185 days.

(21) Appl. No.: 16/180,417

(22) Filed: Nov. 5, 2018

(65) Prior Publication Data

US 2020/0138089 A1 May 7, 2020

(51) Int. Cl.

| | |
|---|---|
| ***A24B 15/16*** | (2020.01) |
| ***A24B 15/42*** | (2006.01) |
| ***B65B 1/32*** | (2006.01) |
| ***B01F 7/00*** | (2006.01) |
| ***A24F 23/02*** | (2006.01) |

(52) U.S. Cl.

CPC ..... *A24B 15/16* (2013.01); *A24B 15/42* (2013.01); *A24F 23/02* (2013.01); *B01F 7/0025* (2013.01); *B65B 1/32* (2013.01)

(58) Field of Classification Search

CPC ..... A24B 15/16

See application file for complete search history.

(56) References Cited

U.S. PATENT DOCUMENTS

| | | | | |
|---|---|---|---|---|
| 4,325,250 | A * | 4/1982 | Bolt | G01M 3/26 73/38 |
| 9,556,142 | B2 | 1/2017 | Arnold | |
| 2004/0123873 | A1* | 7/2004 | Calandro | A24B 15/16 131/359 |
| 2006/0112965 | A1* | 6/2006 | Whalen | A24B 15/16 131/359 |
| 2008/0029117 | A1* | 2/2008 | Mua | A24B 15/10 131/352 |
| 2008/0286409 | A1* | 11/2008 | Topsoe | A23G 4/18 426/5 |
| 2012/0042883 | A1* | 2/2012 | Hillard | B65D 75/38 131/58 |
| 2014/0017286 | A1* | 1/2014 | Nilsson | A61K 9/006 424/400 |

(Continued)

OTHER PUBLICATIONS

Schievelbein et al., "Absorption of Nicotine Through the Oral Mucosa," 1973, pp. 254-258, Agents and Actions vol. 3/4, https://doi.org/10.1007/BF01968551.

(Continued)

*Primary Examiner* — Eric Yaary

(74) *Attorney, Agent, or Firm* — Sand, Sebolt & Wernow Co., LPA

(57) ABSTRACT

Exemplary embodiments contained herein relate to smokeless products containing one or more non-tobacco plant materials and methods of manufacture thereof. Exemplary embodiments are related to the method of manufacture of various chew products containing non-tobacco ingredients including plant material and a starch, a sweetener, natural and artificial flavors, a pH adjuster, solvent, salt, and nicotine and methods of manufacture thereof.

8 Claims, 7 Drawing Sheets

(56) References Cited

U.S. PATENT DOCUMENTS

| | | | | |
|---|---|---|---|---|
| 2015/0024012 | A1* | 1/2015 | Grossman | A61K 47/10 424/400 |
| 2015/0298082 | A1* | 10/2015 | Machuca | B01F 15/00259 366/152.3 |
| 2015/0366262 | A1* | 12/2015 | Woodman | A24B 3/04 131/300 |
| 2019/0200667 | A1* | 7/2019 | Phililps | A24B 15/303 |
| 2019/0350251 | A1* | 11/2019 | Fujihira | A24B 3/12 |

OTHER PUBLICATIONS

"Nicotine Pharmacology and Principles of Addiction," Copyright 1999-2006, pp. 1-5, The Regents of the University of California, University of Southern California, and Western University of Health Sciences.

Benowitz et al., "Nicotine Chemistry, Metabolism, Kinetics and Biomarkers," Handb Exp Pharmacol., 2009; pp. 1-29, (192)29-60. doi: 10.1007/978-3-540-69248-5_2.

Pickworth et al., "Nicotine Absorption from Smokeless Tobacco Modified to Adjust pH," Dec. 19, 2014, pp. 1-11, Journal of Addiction Research & Therapy, vol. 5, Issue 3, 184. doi: 10A172/2155-6105.1000 184.

El-Hellani et al., "Quantification of free-base and protonated nicotine in electronic cigarette liquids and aerosol emissions," Chem Res Toxicol. Aug. 17, 2015; 28(8): 1532-1537. pp. 1-13, Published online Jul. 22, 2015. doi: 10.1021/acs.chemrestox.5b00107.

* cited by examiner

COMPOSITION FOR A TOBACCO-FREE CHEW AND METHOD OF MANUFACTURING SAME

TECHNICAL FIELD

The present disclosure generally relates to a tobacco-free chew product and methods of manufacturing the same. More particularly, the present disclosure relates to a tobacco-free chew product containing plant materials and flavorants and methods of manufacturing the same. Specifically, the present disclosure relates to non-tobacco ingredient plant ingredient, starch, a sweetener, a flavorant, a pH adjuster, solvent, and salt and methods of manufacturing the same.

BACKGROUND

Background Information

In recent years, the harmful effects of tobacco use has been recognized by multiple campaigns both privately funded by various health groups and by governmental agencies. These campaigns have done well to communicate various information about the adverse health effects related to the use of tobacco products. Many of these programs are directed to attempts to reduce the smoking incidence within the population.

Tobacco smoking alone has far reaching impacts on health. It is currently estimated that there are 3-4 million deaths per year around the world directly attributable to tobacco smoking and tobacco smoking related diseases. In a 1988 report entitled *The Health Consequences of Smoking: Nicotine Addiction: A Report of the Surgeon General*, it was estimated that approximately 300,000 deaths each year are caused as a result of cigarette smoking in the US alone. Smoking is internationally recognized as a major cause to health problems throughout the world. Tobacco use costs $300 billion a year in the United States. Currently, 36.5 million adults continue to smoke.

However, quitting using tobacco is extremely difficult. In fact, the World Health Organization has in its International Classification of Disorders a diagnosis called Tobacco Dependence. One primary reason individuals have trouble giving up tobacco products centers around nicotine. Nicotine is an organic compound and is the principal alkaloid of tobacco. Nicotine is the chief addictive ingredient in the tobacco used in cigarettes, cigars, snuff, chew and the like. Nicotine addicts characteristically display a strong tendency to relapse after having successfully stopped using tobacco for a time. Nicotine is the world's second most used drug, after caffeine from coffee and tea.

The administration of nicotine can give satisfaction and the usual method is by smoking. When smoking a cigarette or other tobacco containing product, nicotine is quickly absorbed into the smoker's blood and reaches the brain within around ten seconds after inhalation. The quick uptake of nicotine gives the consumer a rapid satisfaction, or kick. The satisfaction, then, lasts during the smoking time of the cigarette and for a period of time thereafter.

However, tobacco smoke has a lot of dangerous substances that are formed during the combustion of tobacco, such as carbon monoxide, tar products, aldehydes, and hydrocyanic acid. Chewing tobacco comes with its own set of issues as well, including use as a risk factor for the development of oral cancers and precancers. Additionally, using chewing tobacco can include other health risks including, but not limited to gum disease, tooth decay, tooth loss, links to various other cancers and cardiovascular disease.

As a result, there has been a push for tobacco alternative products and methods. Recently "electronic cigarettes", "e-cigarettes" or "personal vaporizers", are becoming increasingly popular. These are often names for a personal vaporizer or vaporizer pen, which is a device that heats and vaporizes a liquid material such as a liquid tobacco or an herbal extraction product without causing combustion. These devices may be used by various people to simulate tobacco smoking, including current or past smokers of tobacco cigarettes and individuals who never were smokers of tobacco cigarettes.

SUMMARY

However, using tobacco and tobacco derived products has health hazards and it is therefore desirable to formulate an alternative way of administering nicotine in a pleasurable manner that can be used to facilitate withdrawal from tobacco and/or used as a replacement for the use of tobacco. Therefore, it is prudent to develop a product free of tobacco, yet still capable of delivering nicotine in an improved manner.

Exemplary embodiments relate to compositions, such as tobacco-free chew, containing a base material free of tobacco plant materials as well as methods of manufacture related thereto. Additionally, these exemplary compositions include synthetic nicotine that is not derived from tobacco.

This exemplary embodiment or another exemplary embodiment may further comprise, a non-tobacco leaf material, a flavorant, and synthetic nicotine. This exemplary embodiment or another exemplary embodiment may further comprise, a dilutant, wherein the dilutant is operative to dilute the synthetic nicotine to a lower amount. This exemplary embodiment or another exemplary embodiment may further comprise a composition has a pH greater than 7; more particularly, the composition according to claim 3, wherein the composition has a pH greater than 7.5. This exemplary embodiment or another exemplary embodiment may further comprise, a composition wherein the amount of free nicotine after being exposed to a dilutant and an alkaline pH would equal that of a similar undiluted concentration.

In an exemplary embodiment a composition of tobacco-free chew comprises mint leaves, ground arrowroot, water, natural flavors, artificial flavors, colors and/or dyes, propylene glycol and nicotine as well as methods of manufacture related thereto.

A further embodiment provides for a composition of tobacco-free chew comprises mint leaves, ground arrowroot, water, natural flavors, artificial flavors, colors and/or dyes, propylene glycol and free of any nicotine as methods of manufacture related thereto.

In one aspect, the present disclosure may provide a composition containing: non-tobacco ingredient plant ingredient, starch, a sweetener, a flavorant, a pH adjuster, solvent, and salt. This exemplary embodiment or another exemplary embodiment may further provide where the sweetener comprises molasses. This exemplary embodiment or another exemplary embodiment may further provide where the pH adjuster includes at least one of baking soda and ammonium salt. This exemplary embodiment or another exemplary embodiment may further provide where the non-tobacco plant ingredient comprises shredded spearmint leaves. This exemplary embodiment or another exemplary embodiment may further provide where the starch component is derived from arrow root. This exemplary embodiment or another exemplary embodiment may further provide where a weight percentage of the non-tobacco plant ingredient and starch is in a range of about 20% to about 40% of the total composition. This exemplary embodiment or another exemplary embodiment may further provide where a weight percentage of the non-tobacco plant ingredient and starch is in a range from about 37% to about 30% of the total composition. This exemplary embodiment or another exemplary embodiment may further provide a weight percentage of the non-tobacco plant ingredient and starch is in a range from about 27% to about 30% of the total composition. This exemplary embodiment or another exemplary embodiment may further provide a weight percentage of sweetener is in a range from about 10% to about 35% of the total composition. This exemplary embodiment or another exemplary embodiment may further provide a weight percentage of sweetener is in a range from about 18% to about 27% of the total composition. This exemplary embodiment or another exemplary embodiment may further provide a weight percentage of flavorant is in a range from about 10% to about 35% of the total composition This exemplary embodiment or another exemplary embodiment may further provide a weight percentage of flavorant is in a range from about 17% to about 26% of the total composition. This exemplary embodiment or another exemplary embodiment may further provide wherein the flavorant comprises natural and artificial flavors. This exemplary embodiment or another exemplary embodiment may further provide a weight percentage of pH adjuster is in a range from about 0.1% to about 3% of the total composition. This exemplary embodiment or another exemplary embodiment may further provide a weight percentage of pH adjuster is in a range from about 0.5% to about 1.0% of the total composition. This exemplary embodiment or another exemplary embodiment may further provide a weight percentage of solvent, wherein the solvent is water and is in a range of about 15% to about 30% of the total composition. This exemplary embodiment or another exemplary embodiment may further provide a weight percentage of solvent is in a range of about 20% to about 24% of the total composition. This exemplary embodiment or another exemplary embodiment may further provide a weight percentage of salt is in a range of about 0.5% to about 3% of the total composition. This exemplary embodiment or another exemplary embodiment may further provide a weight percentage of salt is about 0.5-1% of the total composition This exemplary embodiment or another exemplary embodiment may further comprise nicotine, wherein the nicotine comprises synthetic nicotine at a general ratio of vegetable glycerin to synthetic nicotine from 2:1 to 4:1 more particularly, glycerin to synthetic nicotine is 3:1. This exemplary embodiment or another exemplary embodiment may further provide a weight percentage of nicotine is about 0.5% to about 5% of the total composition. This exemplary embodiment or another exemplary embodiment may further provide a weight percentage of nicotine is about 1.6% to about 3.5% of the total composition.

This exemplary embodiment or another exemplary embodiment may further provide for a plasticizer, wherein the plasticizer comprises propylene glycol and is generally at a weight percentage of plasticizer is up to about 10% of the total composition, and is more particularly at a weight percentage of plasticizer is up to about 6% of the total composition. wherein the percent weight of the plasticizer is up to about 6% of the total weight of the composition.

In another aspect, the present disclosure may provide a method of making a tobacco-free chew composition comprising: measuring ingredients, including non-tobacco ingredients including non-tobacco plant material, a starch, a sweetener, a flavorant, a pH adjuster, a solvent, and salt, adding said ingredients into a mixer, mixing said ingredients in the mixer, drying the mixed ingredients, and packaging the ingredients into a package. This exemplary embodiment or another exemplary embodiment may further provide subsequent to packaging, diluting the synthetic nicotine with a dilutant, wherein a ratio of the dilutant to the synthetic nicotine in a range from about 2:1 to about 4:1. This exemplary embodiment or another exemplary embodiment may further provide where adding of the ingredients includes: adding half of the wet ingredients to the mixer; adding half of the dry ingredients to the mixer; adding the rest of the wet ingredients to the mixer; and adding the rest of the dry ingredients to the mixer. This exemplary embodiment or another exemplary embodiment may further provide dyeing the starch material with a dye, wherein dyeing the starch material includes weighing the starch material, calculating out a brown colored dye at a concentration of about 1.75 oz per pound of starch material, adding the dye to the starch material and mixing the starch material in a mixer. This exemplary embodiment or another exemplary embodiment may further provide prior to drying the mixed ingredients occurs, determining if the ingredients are sufficiently mixed. This exemplary embodiment or another exemplary embodiment may further provide prior to packaging the ingredients occurs, weighing the mixed ingredients after drying to determine moisture content, determining if the mixed ingredients are at the proper moisture content, redrying the mixed ingredients if the mixed ingredients are not at the proper moisture content for an additional time, and passing the mixed ingredients on to packaging if they are sufficiently dry. This exemplary embodiment or another exemplary embodiment may further provide where packaging the ingredients includes: filling the package, weighing the package, determining proper package weight, returning the package to for more mixed ingredients to be added if the package is below proper weight, sealing the package if it is at the proper weight and subsequent to packaging, refrigerating the package. This exemplary embodiment or another exemplary embodiment may further provide subsequent to refrigerating the package and further comprising, checking the package for any leaks, discarding the package if it has the presence of any leaks, preparing to sell the package if it is substantially free of any leaks. This exemplary embodiment or another exemplary embodiment may further provide measuring an amount of nicotine.

In one aspect, the present disclosure may provide a composition consisting essentially of: non-tobacco plant ingredient, starch, a sweetener, a flavorant, a pH adjuster, solvent, and salt.

In another aspect, the present disclosure may provide a composition comprising a non-tobacco leaf material, a flavorant; and synthetic nicotine that is not derived from tobacco. This exemplary embodiment or another exemplary embodiment may further provide for a dilutant, wherein the dilutant is operative to dilute the synthetic nicotine to a lower concentration. This exemplary embodiment or another exemplary embodiment may further provide a ratio of dilutant to synthetic nicotine in a range from about 2:1 to about 4:1. This exemplary embodiment or another exemplary embodiment may further provide for a ratio of dilutant to synthetic nicotine is about 3:1. This exemplary embodiment or another exemplary embodiment may further provide for an amount of free nicotine in the synthetic nicotine, after being exposed to the dilutant and an alkaline pH approximates a similar amount of free nicotine in an undiluted concentration at a neutral or acidic pH. This exemplary embodiment or another exemplary embodiment may further provide for a starch, a sweetener, a pH adjuster, a solvent and a salt. This exemplary embodiment or another exemplary embodiment may further provide wherein the pH adjuster includes one of baking soda and an ammonium salt. This exemplary embodiment or another exemplary embodiment may further provide for the non-tobacco leaf material comprises shredded spearmint leaves.

This exemplary embodiment or another exemplary embodiment may further provide for the composition has a pH greater than 7. This exemplary embodiment or another exemplary embodiment may further provide for the composition has a pH greater than 7.5.

BRIEF DESCRIPTION OF THE SEVERAL VIEWS OF THE DRAWINGS

A sample embodiment of the disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
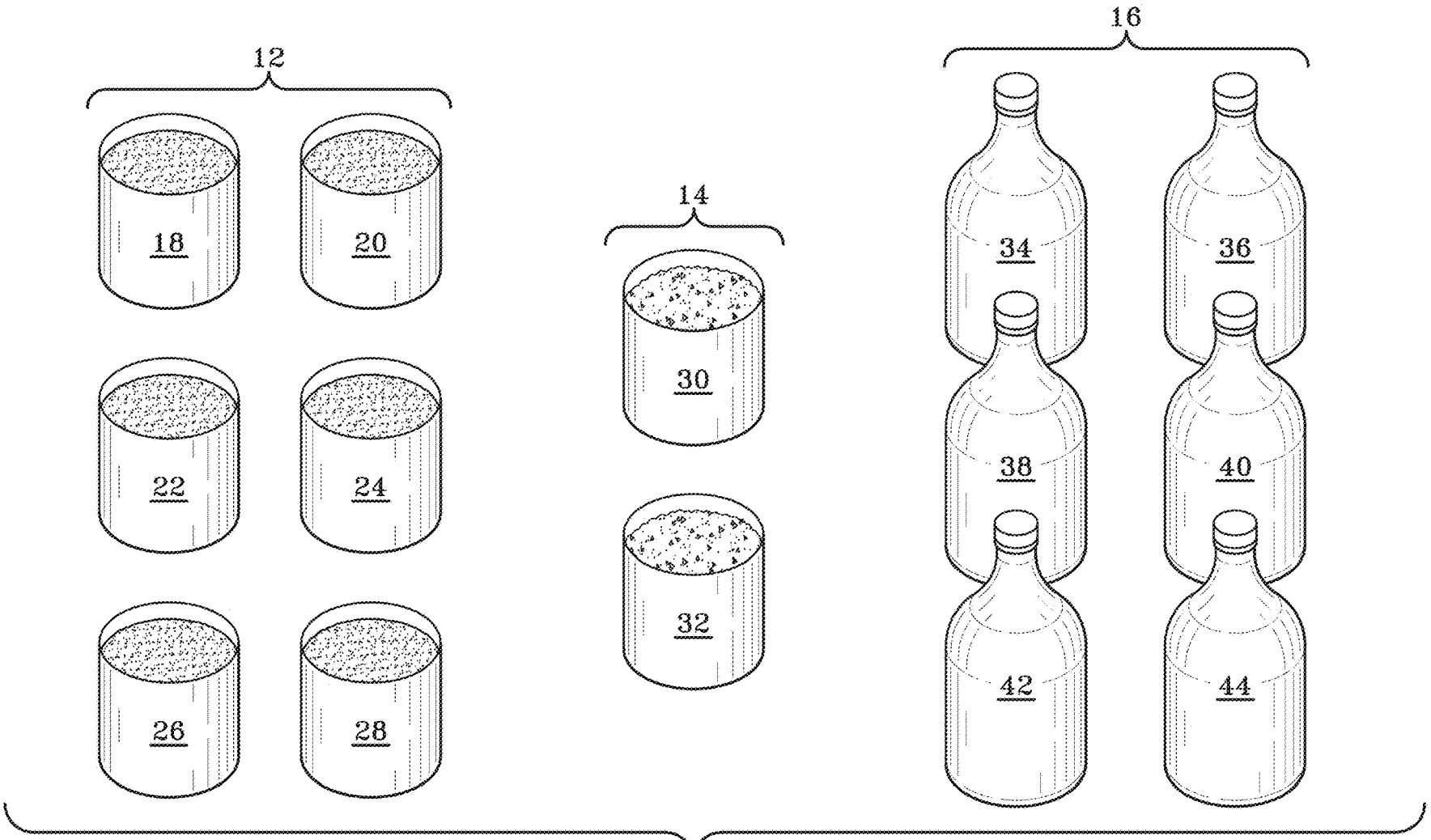
FIG. 1 is a perspective view of various containers of ingredients.

Referring now to the figures, FIG. 1 shows containers of various ingredients 10 that are to be combined to form a composition 54 for a tobacco free chew product adapted to be retained with a user's mouth. The ingredients 10 are separated into two main categories. Dry ingredients 12 having a subset of the dry ingredients 12 as plant based ingredients 14, and wet ingredients 16. Dry ingredients may be comprised natural flavorants 18, artificial flavorants 20, pH adjusters such as an ammonium salt 22, baking soda 24, a salt component 26, and a dry sweetener 28, such as xylitol, along with of alternative plant based ingredients to tobacco including mint leaves 30 and a starch containing compound 32. The wet ingredients 16 may include a wet sweetener 34, such as molasses, solvent 36, liquid or emulsion based flavorants 38, nicotine 40, plasticizer 42, such as propylene glycol, and a dilutant 44.

As tobacco has both texture as well as plant matter, and it is desirable to recreate the chew of tobacco with other plant matter 14, or tobacco-alternative plant based ingredients 14. An exemplary embodiment herein provides for the use of mint leaves 30 and a starch containing compound 32, such as arrowroot.

An exemplary embodiment provides for the use of mint leaves 30 as a source of tobacco-alternative plant materials. As used herein "mint leaves" refers to plants of the genus *Mentha*. The genus *Mentha* includes but is not limited to those listed in the USDA, ARS, National Genetic Resources Program, Germplasm Resources Information Network—(GRIN), National Germplasm Resources Laboratory, Beltsville, Md. Examples of this genus include, but are not limited to: *Mentha aquatica, Mentha canadensis, Mentha cervina, Mentha japonica, Mentha logifolia, Mentha piperita, Mentha pulegium, Mentha spicata*, and *Mentha suaveolens*. Mint leaves may provide a source of a dry ingredient. The term "leaves" or "mint leaves" specifically excludes any corn derived product or substance. An exemplary embodiment of the chew allows for spearmint leaves to make up 15-30% of the chew. The spearmint leaves may more particularly include about 17-23% of the chew.

In exemplary embodiments, the composition includes a starch containing compound 32 as a source of tobacco-alternative plant based ingredients 14. The starch containing compound 32 is operative to adequately simulate the consistency of chewing tobacco.

Starch is the most abundant storage carbohydrate in higher plants. Starches comprise primarily amylase and amylopectin, but the physical properties of starches and, therefore, the applications, depend on the starch composition and are unique for each botanical source. As an example, starch from different plants may comprise amylose and amylopectin in varying ratios along with a varying chain length and varying degrees of branching. Some starches further comprise additional components, such as phosphates, lipids, and/or proteins. Starches may exhibit varying levels of cross-linking between polymer chains. Further, starch can vary in average granule size, size distribution, and shape. For example, rice-derived starch is generally around 2 μm, maize-derived starch is generally around 12-30 μm, wheat-derived starch is generally around 30-45 μm, and potato-derived starch is generally around 50-100 μm.

These and other differences can significantly affect the physical properties of the starch. For example, they may impact the swellable potential of starch granules, that is how much water may be held by the starch. For example, the higher the crystallinity of the starch, the higher the swellable potential of the starch. The crystallinity of a given starch is, in turn impacted by the ratio of amylase to amylopectin. High levels of amylase typically decrease the crystallinity of a starch, and thus, decrease the swellable potential. The crystallinity is also impacted by the size and shape of starch granules, as smaller, spherical granules are typically less crystalline and thus have less swelling potential.

An exemplary embodiment uses arrowroot powder as the starch compound 32. Raw arrowroot may be processed to a desired texture by the facility making the chew, or may be processed prior to arriving, including being modified, as discussed below. Other exemplary sources of starch compound 32 may include, but are not limited to, arrowroot, arracacha, bananas, barley, beans, breadfruit, buckwheat, canna, chestnuts, colacasia, katakuri, kamut, kudzu, malanga, millet, oats, oca, Polynesian arrowroot, sago, sorghum, sweet potato, quinoa, rice, rye, spelt, tapioca, taro, tobacco, triticale, water chestnuts, and yams.

In exemplary embodiments, certain starches may be modified starches. A modified starch has undergone one or more structural modifications, often designed to alter its properties. Most notably, heat stability. Other exemplary starches have been developed by genetic modifications, and are considered to be "modified" starches. Other starches are obtained from plant based material and subsequently modified. For example, modified starches can be starches that have been subjected to chemical reactions, such as esterification, etherification, oxidation, depolymerization (thinning) by acid catalysis or oxidation in the presence of base, bleaching, transglycosylation and depolymerization (e.g., dextrinization in the presence of a catalyst), cross-linking, enzyme treatment, acetylation, hydroxypropylation, and/or partial hydrolysis. Exemplary embodiments may be modified by heat treatments, such as pregelatinization, dextrinization, and/or cold water swelling processes. In other embodiments, certain modified starches may include, but are not limited to: monostarch phosphate, distarch glycerol, distarch phosphate esterified with sodium trimetaphosphate, phosphate distarch phosphate, acetylated distarch phosphate, starch acetate esterified with acetic anhydride, starch acetate esterified with vinyl acetate, acetylated distarch adipate, acetylated distarch glycerol, hydroxypropyl starch, hydroxypropyl distarch glycerol, starch sodium octenyl succinate.

An exemplary embodiment of the chew composition 54 allows for tobacco-alternative plant based ingredients 14 and starch 32 to generally include about 20-40% of the total weight of the chew composition 52. The tobacco-alternative plant based ingredients 14 and starch 32 in the chew may more particularly include about 27-30% of the total weight of the chew.

Exemplary embodiments may contain nicotine 40. In some cases, liquid nicotine can be tobacco-derived nicotine, synthetic nicotine, or combinations thereof. Liquid nicotine can be purchased from commercial sources, whether tobacco-derived or synthetic. Tobacco-derived nicotine can include one or more other tobacco organoleptic components other than nicotine. The tobacco-derived nicotine can be extracted from raw tobacco and/or processed tobacco. In one particular embodiment, the nicotine is not derived from tobacco. This exemplary embodiment may be advantageous because the synthetic nicotine is free of any other secondary compounds ordinarily found in tobacco derived nicotine which have been linked to cancer. It is possible to obtain a 100% concentrate from a synthetic nicotine supplier, namely, Next Generation Labs LLC of San Diego, Calif. The process of which to make the nicotine is described in U.S. Pat. No. 9,556,142 and is herein incorporated by reference.

The liquid nicotine can be pure, substantially pure, or diluted with a dilutant 44 prior to combination with the tobacco-free plant material. Particularity, the synthetic nicotine may make use of a dilutant 44 may be any compound operative to dilute the nicotine 40 or other additives. Exemplary dilutants 43 include, but are not limited to, propolene glycol, vegetable glycerin, aqueous vegetable glycerin, distilled water, glycerol, ethylene glycol, diethylene glycol, triacetin, ethyl laurate, diethyl suberate, triethylene glycol, glycerin, ethyl vanillate, triethyl citrate, tributyrin, diethyl sebacate, benzyl phenyl acetate, benzyl benzoate, erythritol, tetraethylene glycol, ethyl stearate, dioctyl sebacate and mixtures thereof.

In exemplary embodiments, liquid nicotine is generally diluted with a dilutant 44 to a concentration of between 20 to 33 weight percent with vegetable glycerin, or a 2:1-4:1 ratio, prior to mixing the liquid nicotine with the remaining ingredients. In further exemplary embodiments, liquid nicotine is more particularly diluted to a concentration of between 25 weight percent with vegetable glycerin, or a 3:1 ratio prior to mixing the liquid nicotine with the remaining ingredients. In some embodiments, the chew generally includes about 0.5-5% of the total weight of the chew of nicotine 40. The nicotine 40 more particularly includes up to about 3.5% of the total weight of the chew.

As a result of this dilution, coupled with an alkaline or basic pH, may be effective to increase the amount of 'free base' nicotine delivered to a user. This may then allow a user to experience more nicotine, even though less of an amount is used in the formulation as a whole. This will be discussed further below.

Any of the products described herein can optionally include one or more additional ingredients. For example, in some embodiments, the chew composition 54 product can include, but are not limited to, one or more solvents 36, sweeteners 28, 34 humectants, flavorants 18, 20, 38, plasticizers 42, pH stabilizers and pH adjustors 22, 24, preservatives dilutants 43 and combinations thereof, such that the base or the product in its final form mimics the flavor profile and tactile experience of certain tobacco-containing products. In some embodiments, a single substance can serve as both a plasticizer 42 and a humectant, both a humectant and a flavorant 18, 20, 38, both a plasticizer 42 and a flavorant 18, 20, 38, a sweetener 28, 34 and a flavorant 18, 20, a plasticizer 42 and a dilutant 44, or as all five, or a combination not listed for the sake of brevity. For example, molasses can serve as a humectant, sweetener 28, 34 and a flavorant 18, 20, 38. For example, propylene glycol can serve as a plasticizer, dilutant 44 and a humectant.

An exemplary embodiment of the chew composition 54 contains a solvent 36. In exemplary embodiments, the solvent 36 is water. Water acts as a solvent of certain water soluble molecules as well as a way to dissolve other ingredients. It should be understood that water could mean any of tap water, potable water, distilled water, deionized water, spring water, bottled water or water with a specific mineral composition to improve the chew product. In additional embodiments, ethanol, denatured ethanol, or other known food-safe additives as solvents 36 or combination of solvents 36 may be used. In some embodiments, the chew generally includes about 15-30% of the total weight of the chew of solvent 36. The solvent 36 more particularly includes about 20-24% of the total weight of the chew.

In some embodiments, the chew can include the sweetener 28, 34. Such sweeteners 28, 34 are operative to make the product taste sweet and pleasant to human taste buds. A variety of synthetic and/or natural sweeteners 28, 34 can be used as in the diluent or added separately to the tobacco-free chew. Suitable natural sweeteners include sugars, for example, monosaccharides, disaccharides, and/or polysaccharide sugars, and/or mixtures of two or more sugars. In some embodiments, a diluent can include one or more of the following: sucrose or table sugar; honey or a mixture of low molecular weight sugars not including sucrose; glucose or grape sugar or corn sugar or dextrose; molasses; corn sweetener; corn syrup or glucose syrup; fructose or fruit sugar; lactose or milk sugar; maltose, maltriose, dextrin, maltodextrin; sorghum syrup; mannitol or manna sugar; sorbitol or d-sorbite or d-sobitol; xylitol, fruit juice concentrate; and/or mixtures or blends of one or more of these ingredients. Additional embodiments may contain non-nutritive sweeteners. Suitable non-nutritive sweeteners may include, but are not limited to, *stevia* (mainly stevioside and rebaudioside), saccharin, aspartame, sucralose, and acesulfame potassium. In some embodiments, the chew generally includes about 10-35% of the total weight of the chew of sweetener 28, 34. The sweetener 28, 34 more particularly includes about 18-27% of the total weight of the chew.

In an exemplary embodiment, the chew can include a humectant. A humectant is a substance that can be used to keep things moist, as such humectants can be hygroscopic. Suitable humectants include but are not limited to propylene glycol, hexylene glycol, butylene glycol, glyceryl triacetate, vinyl alcohol, neoagarobiose, sugar polyols (such as glycerol, sorbitol, xylitol, maltitol, mannitol, and isomalt), polymeric polyols, *quillaia*, alpha hydroxyl acids (e.g., lactic acid), glycerin, aloe vera gel, molasses, and honey. In some embodiments, humectants can reduce the water activity of the product. In some embodiments, the chew generally includes about 10-45% of the total weight of the chew of humectant. The humectant more particularly includes about 18-30% of the total weight of the chew.

In exemplary embodiment, flavorants 18, 20, 38 may be used. Flavorants 18, 20, 38 are as a substance that gives another substance flavor, altering the characteristics of the solute, causing it to become sweet, sour, tangy, or other flavors. Flavorants 18, 20, 38 can be both natural or artificial. Exemplary flavorants 18, 20, 38 may be selected from the following, but not limited to: licorice, wintergreen, peach, cherry and berry type flavorants, Drambuie, bourbon, scotch, whiskey, spearmint, peppermint, lavender, cinnamon, cardamon, *apium* graveolents, clove, cascarilla, nutmeg, sandalwood, bergamot, apricot, geranium, honey essence, rose oil, vanilla, lemon oil, orange oil, Japanese mint, *cassia*, caraway, cognac, jasmin, chamomile, capsaicin, menthol, ylangylang, sage, fennel, pimento, cayenne pepper, ginger, anise, coriander, coffee, mint oils from a species of the genus *Mentha*, cocoa, tobacco free latakia and combinations thereof. Synthetic flavorants can also be used. In certain embodiments, a combination of flavorants 18, 20, 38 can be combined to imitate a tobacco flavor without tobacco. In other embodiments the flavorants 18, 20, 38 may be combined in a way to mimic various fruits, such as cherry or peach. In other embodiments the flavorants 18, 20, 38 are operative to mimic various mint flavors. The particular combination of flavorants 18, 20, 38 can be selected from the flavorants 18, 20, 38 that are generally recognized as safe for food consumption. These flavorants 18, 20, 38 may be added in the form of extracts, raw materials, powder, oil, tinctures, emulsions, and will be understood to those in the arts what may be required (depending on the solubility of various flavorants in various solvents). In some embodiments, the chew generally includes about 10-35% of the total weight of the chew of flavorant 18, 20, 38. The flavorant 18, 20, 38 more particularly includes about 17-26% of the total weight of the chew.

In certain embodiments, as a flavorant, cayenne pepper or other capsaicin containing compounds are used as a flavorant. The cayenne pepper or other capsaicin compounds are used in order to best mimic a traditional chew product that may contain fiberglass, or glass particles, as an aid to the absorption of nicotine by the user's blood. Additionally, this burn may also be created by a user's mucous membranes readily absorbing free nicotine. As certain embodiments do not use nicotine, and no embodiment uses fiberglass, it may be advantageous for consumers to get the same burn as they would from traditional chew. Therefore, cayenne pepper or other capsaicin containing compounds may be implored in order to produce a sensation of burning sensation in any tissue with which it comes into contact.

In certain exemplary embodiments, plasticizers 42 may be used. Plasticizers 42 can, in some embodiments, soften the product, promote flexibility and reduce brittleness. Suitable plasticizers 42 include but are not limited to propylene glycol, vegetable oil, glycerin, partially hydrogenated vegetable oil, esters of polycarboxylic acids with linear or branched aliphatic alcohols of moderate chain length, and medium chain triglycerides. In some embodiments, the chew generally includes up to about 10% of the total weight of the chew of plasticizer 42. The plasticizer 42 more particularly includes up to about 6% of the total weight of the chew.

In an exemplary embodiment, a pH stabilizer or pH adjuster 22, 24 may be implored. A pH stabilizer or pH adjuster 22, 24 will allow the pH of the solution to be maintained over a shelf life along with changing the pH to better suit the product. Additionally, the pH stabilizer or pH adjuster 22, 24 may adjust the solubility of other ingredients. The pH stabilizer or pH adjuster 22, 24 may vary based on the solvents and other ingredients used in the chew. The pH stabilizer or pH adjuster 22, 24 may also vary based on the amount of nicotine desired to be in chew. However, a wide variety of pH stabilizers and pH adjusters 22, 24 may be used. Examples of pH stabilizers and pH adjusters 22, 24 that may be used in exemplary solutions include but are not limited to: citric acid, acetic acid, phosphoric acid, benzoic acid, ascorbic acid, sodium hydroxide, glycolic acid, ammonium carbonate, ammonium phosphate, ammonium chloride, sodium carbonate, sodium bicarbonate and ammonium hydroxide or mixtures thereof. In an exemplary embodiment the pH adjuster or pH stabilizer include baking soda and an ammonium salt. In some embodiments, the chew generally includes about 0.1-3% of the total weight of the chew of pH stabilizer or pH adjuster 22, 24. The pH stabilizer or pH adjuster 22, 24 more particularly includes about 0.5-4% of the total weight of the chew.

Nicotine absorption from smokeless products is influenced by the pH at the cheek. In an alkaline pH (or pH>7), environment nicotine is unionized and rapidly absorbed whereas in an acidic (or pH<7), nicotine is ionized and does not cross biological membranes nearly as well. Absorption of nicotine across the membranes within it's a user's mouth is directly related to the amount of nicotine present in the unionized "free base" form. Tobacco naturally occurs in an acidic form and therefore is slow to release free-base nicotine unless buffered to alkaline levels. Similarly, the chew product implores various pH stabilizers or pH adjusters 22, 24 to raise the pH to an alkaline level, and be operative to maintain the chew at such an alkaline level once placed into a user's mouth. In certain exemplary embodiments, the pH may be greater than 7.0. In a further exemplary embodiment, the pH may be greater than 7.5. In a further exemplary embodiment, the pH may be greater than 8.0. In a further exemplary embodiment, the pH may be greater than 8.5.

Therefore, by increasing the pH will result in a subsequent increase to the amount of free base nicotine. This may be adequately manipulated in such a way to give a user a similar effect that more nicotine is present, while in reality there is less nicotine. This may be exploited to save substantial money on nicotine costs, as more dilutant 44 could be used to dilute the nicotine to desired levels.

In a further exemplary embodiment, a preservative may be used. Food preservatives that are generally utilized in food or food related products are set forth in the U.S. Food and Drug Administration GRAS list of chemicals utilized in the food industry. Exemplary preservatives include, but are not limited to: ascorbic acid, ascorbyl palmitate, benzoic acid, butylated hydroxytoluene (BHT), calcium ascorbate, EDTA, calcium sorbate, caprylic acid, dehydroacetic acid or its sodium salt, disodium ethylenebisdithiocarbamate, erythorbic acid, formaldehyde (paraformaldehyde), methylparaben (methyl-p-hydroxybenzoate), nitrates (sodium and potassium), n-octanoic (caprylic) acid, octyl gallate, potassium metabisulfite, potassium nitrate, potassium sorbate, propionic acid, propylparaben (propyl-p-hydroxybenzoate), quaternary ammonium chloride combination, silver nitrate, silver (metal), sodium ascorbate, sodium benzoate, sodium bisulfite, sodium dimethyldithiocarbamate, sodium metabisulfite, sodium nitrate, sodium nitrite, potassium nitrite, sodium phosphate (monobasic) (monosodium phosphate), sodium propionate, sodium sorbate, sorbic acid, stannous chloride, stearyl citrate, sulfating agents, sulfur dioxide, and tocopherols, or any combination thereof. In some embodiments, the chew can include up to about 2 weight percent preservative.

In a further exemplary embodiment, a salt 26 or brine solution may be implored. The brine is a solution that can include water and one or more inorganic salts, these salts may be in a brine or by themselves. Exemplary salts may NaCl, KCl NaNO, KNO, MgCl, MgSO, CaOI, or combinations thereof. In the case of NaCl, it may be in the form of kosher salt, sea salt, iodized (table) salt, canning salt, and/or pickling salt. In some embodiments, the chew generally includes about 0.5-3% of the total weight of the chew salt 26 and/or brine. The salt 26 more particularly includes about 0.5-1.0% of the total weight of the chew.

Figure 2:
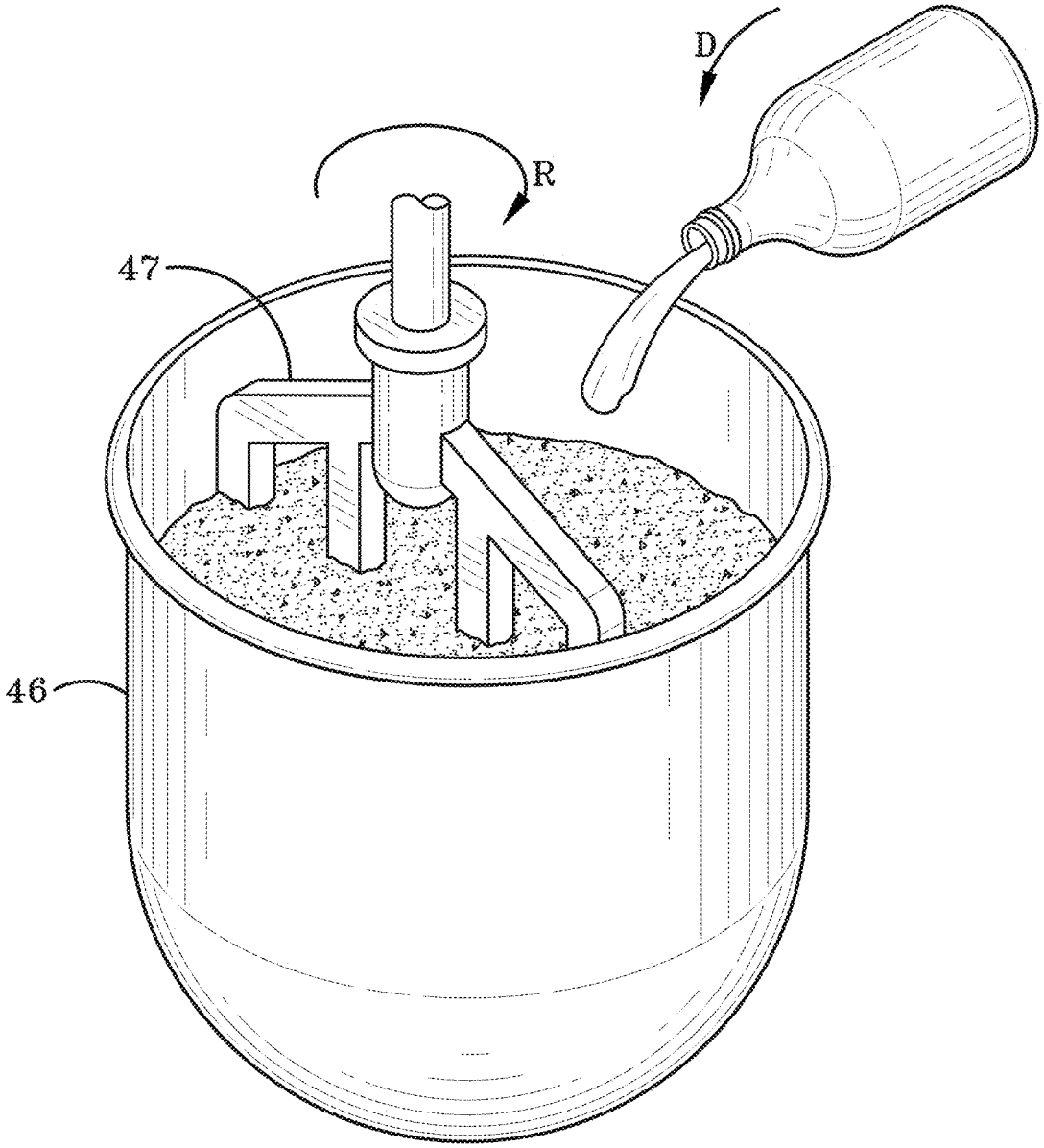
FIG. 2 is a perspective view of an exemplary mixer focused on the mixing bowl with the paddle operative to spin, as liquid ingredients are added.

FIG. 2 refers to the ingredients that are subsequently added to a mixing bowl 46 after being measured in their appropriate proportions. The mixing bowl 44 is mixed by a paddle attachment 47 in a rotating manner as seen by arrow "R". At times it may be useful to add in additional wet ingredients 16 prior to mixing as seen by arrow "D".

An exemplary embodiment relates to a method of manufacturing a tobacco-free chew composition 54. Ingredients are measured out and placed into a mixer and into a mixing bowl 46 or vessel of appropriate size based on batch size. The mixer is operative to rotate a paddle attachment 46 to adequately mix the ingredients. Exemplary mixers are commercial mixers made by Hobart and other companies and are well known in the art. Ingredients may be separated into wet and dry ingredients before they are added to the mixer. This separation of ingredients is desirable as if the dry ingredients are added partially first, and then the wet ingredients 16, and then the rest of the dry ingredients 12. Adding the ingredients in this manner, it allows the ingredients room to move and not be ejected from the mixer as the wet ingredients 16 hydrate some of the dry ingredients 12 prior to mixing. In other embodiments, it may be appropriate to add half of the dry ingredients 12, then half of the wet ingredients 16, the other half of dry ingredients 12 followed by the other half of wet ingredients 16. In an alternative embodiment, the dry ingredients 12 may be split in half, wherein the first half of the dry ingredients 12 may be added to an exemplary mixer, all of the wet ingredients 16 are added, with the exception of a sweetener 28, 34, for example molasses. Then, the remainder of the dry ingredients 12 are added, and then topped with the sweetener 28, 34. Alternative embodiments include adding the wet ingredients 16 and dry ingredients 12 incrementally over a period of time at related rates.

In an exemplary embodiment, after measuring out the ingredients and adding them to a mixer, it is mixed for a time. Depending on the desired moisture content, volume of the ingredients and speed of the mixer, this could be anywhere from 10 minutes to 4 hours. In an exemplary Hobart mixer, it is mixed for 30 minutes on the lowest setting, one.

Figure 3:
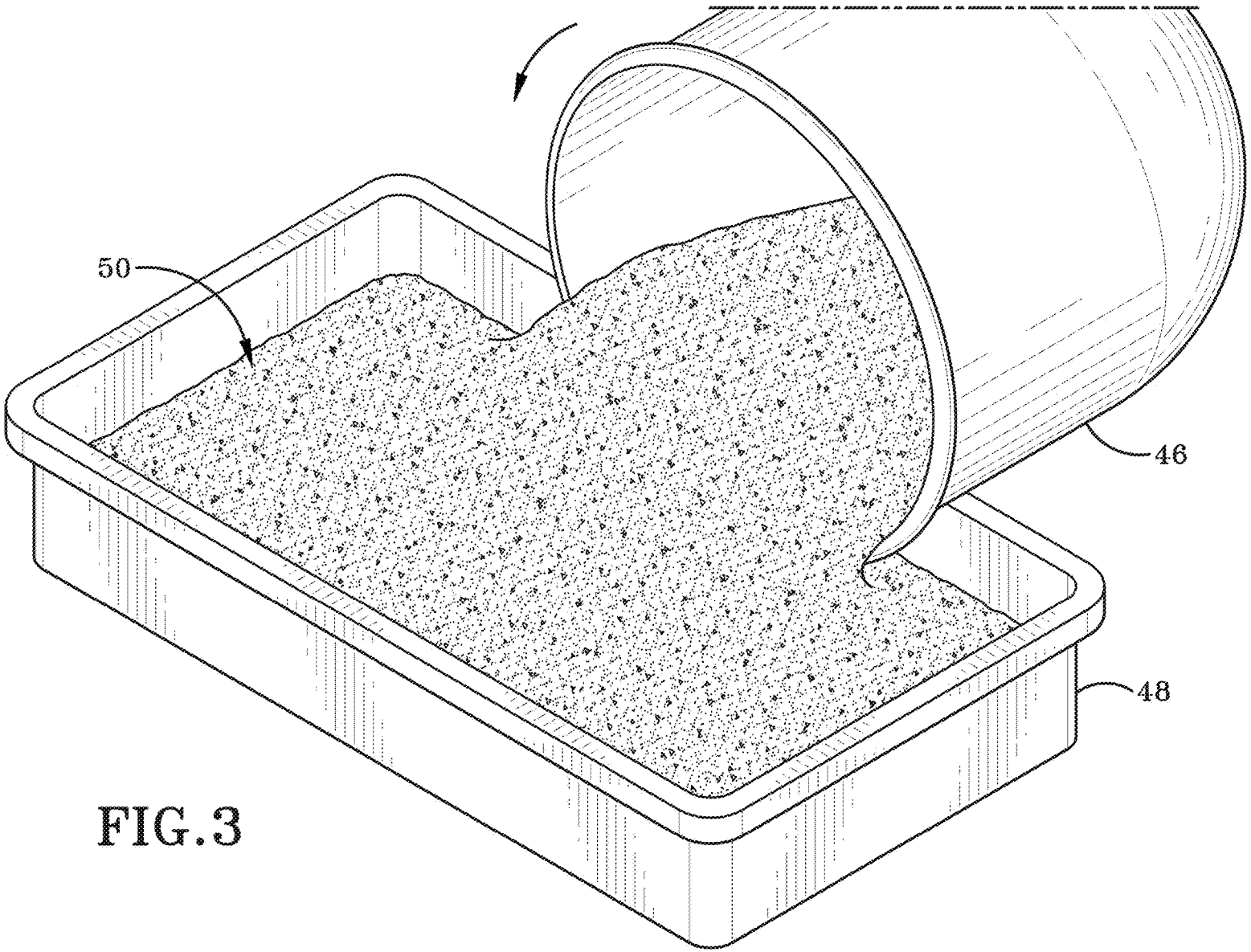
FIG. 3 is a perspective view of the mixing bowl being emptied into a tray.

FIG. 3 refers to the ingredients that are mixed in a mixing bowl 46 subsequently transferred into a drying bin 48 after being mixed into a relatively homogeneous mixture 50.

After the mixing is done, the batch is transferred into a drying bin 48. A drying bin may be any container operative to evaporate moisture within an environment. An exemplary embodiment provides for a shallow tub, but any container with proper air flow and a requisite high surface area would be operative to accomplish the desired function. Air flow may be passive, or dynamic and accomplished by an exemplary fan or blower apparatus.

Figure 4:
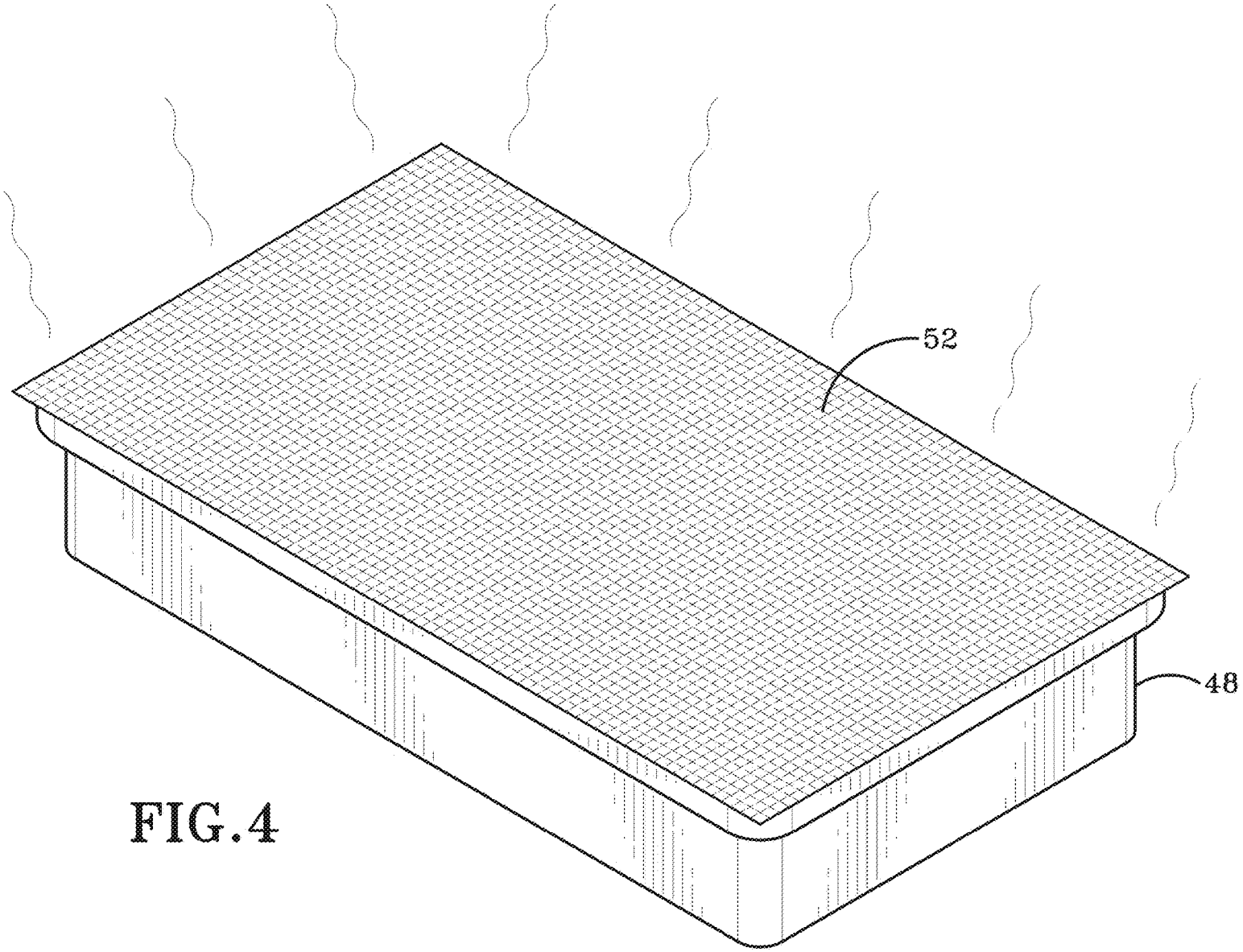
FIG. 4 is a perspective view of the tray covered with a screen, allowing for evaporation.

FIG. 4 refers to the evaporation of water and other volatiles while a screen 52 is placed over the drying bin 48.

An exemplary drying bin 48 has netting or a screen 52 draped across the drying bin 48 to allow moisture to escape. In an alternative embodiment, the drying in 48 has a fitted lid operative to allow appropriate airflow through. In one embodiment, drying may occur in a drying room with an appropriate humidity and moisture level sensor. The drying room may be kept at a constant temperature and at a positive pressure to avoid bugs or other vermin, and as such the drying may occur without the use of a screen 52 or netting. In a further alternative embodiment, the chew may be transferred into an oven in order to drive off excess moisture and volatile compounds. This drying step dries off approximately 6-13% of the total weight of the chew.

Figure 5A:
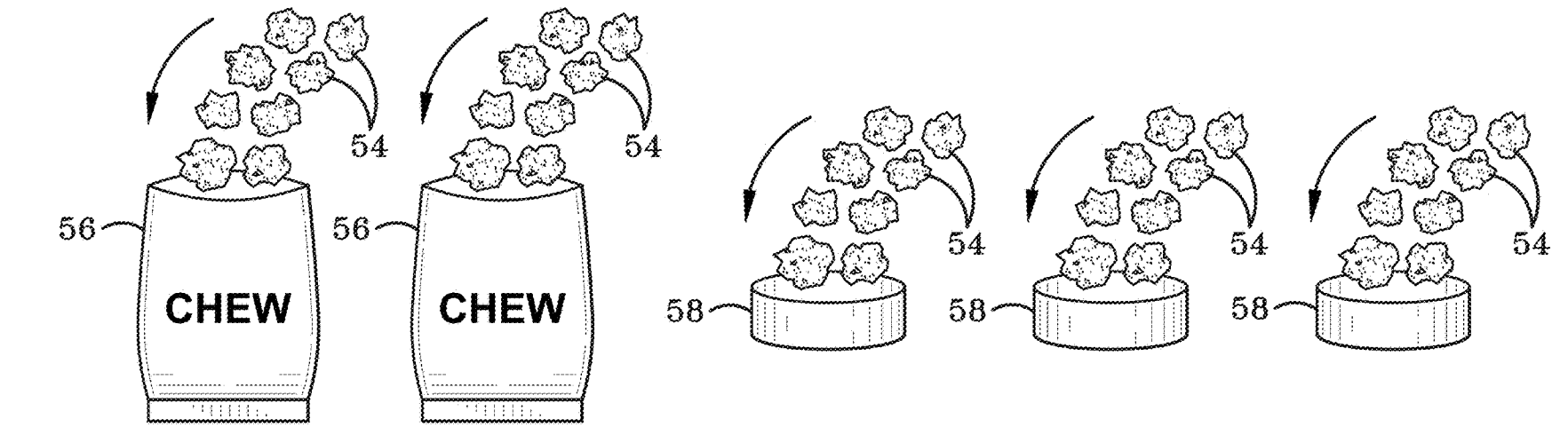
FIG. 5A is a view of chew product being added to exemplary containers including pouches and cans.

FIG. 5A refers to placing the chew 54 into a package that includes a pouch 56 or a puck like container 58.

Once the moisture level reaches a desired state, the bins that have been dried are then put into the packaging process. In some embodiments, the product 54 provided herein can be placed into a container, such as a puck like container 58 (can), a bag, or a pouch 56. These containers may be packaged by hand or machinery operative to do so. The containers have a known tare weight, and the desired package is packed with chew 54 product. It is then weighed, either by an individual, or by the packing machine to determine its weight. If the weight is within range of the desired packing weight (dependent on moisture content), then it is ready to continue on the process of making it. If the weight is too high, then the chew 54 may be returned to an exemplary drying bin 48 to allow additional moisture and volatiles to escape.

In some embodiments, the compositions provided herein can be used to form a sort of loose leaf smokeless product, or a smokeless product in a finely ground or cut or shredded, a moist cut form, a milled form, a powder form, a pouch form, or snus. In some embodiments, the products provided herein can be used to form a smokeless chew product that includes a dipping product, a dip product, or a snus product. All of these are referred to as "the chew" or "chew" or "chew product" herein. As such, the product is not to be ingested, but stuck under the lip and 'dipped' like traditional chewing tobacco.

An alternative embodiment provides for a pouch made out of filter paper. The exemplary pouch is operative to allow the chew composition to mix with a user's saliva or other source of moisture and allow a free exchange of flavor, sweeteners, and other components within the chew, but otherwise retain the composition to prevent the chew from dispersing itself through a user's mouth. In an exemplary embodiment, the filter paper is a coffee filter like material, however it will be understood that the filter may be any material with appropriate sized apertures to effectuate the proper exchange of flavors, sweeteners and other components with a mouth of a user.

Figure 5B:
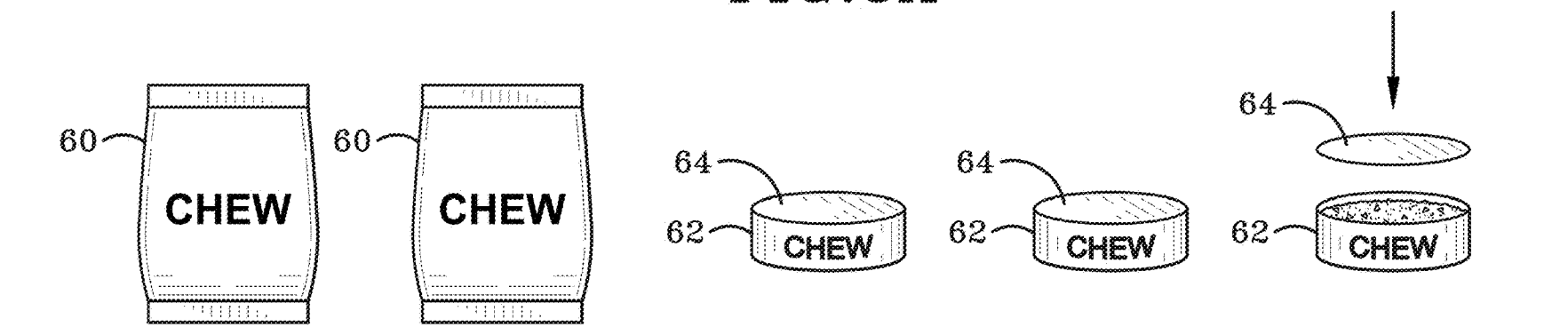
FIG. 5B is a view of exemplary sealed and packaged chew.

FIG. 5B refers to sealing the containers with a seam in a pouch 60 or in a can 62 with lid 64. Once the packages are packed, the labels are applied and the packaged chew is stored in a cooler. Cooler temperatures help with the labels to prevent bleeding of the chew out of the package. Condensation can form when warm air holding water in a vapor, cools down and that cooler air can no longer hold the same amount of moisture. This moisture collects on a cold surface in very tiny droplets almost a mist and those tiny droplets will congregate to form even bigger droplets that can then start running down the walls of the container quickly get absorbed into the nearest water absorbing material, which is usually the paper of the label itself. Therefore, at times, if the chew is in a can and paper labels are put on and the product is left on a shelf, some of the liquid may bleed out because the can lids do not create a perfect seal to avoid this moisture. However, when the packages are cooled or kept in a refrigerated state, the bleeding through the label is lessened or reduced. This is likely because the condensation is reduced as the cold air does not hold as much water as the warm air left within the packaging. As such, unsightly packaging as well as rejected packaging is reduced.

In some embodiments, the chew can be packaged, and/or treated in a nitrogen or other inert gas environment or with nitrogen gas or other inert gas to reduce the amount of oxidation of particular components (e.g., flavors and/or nicotine) in the final product. This can help to extend the product stability over an extended shelf life.

Figure 6:
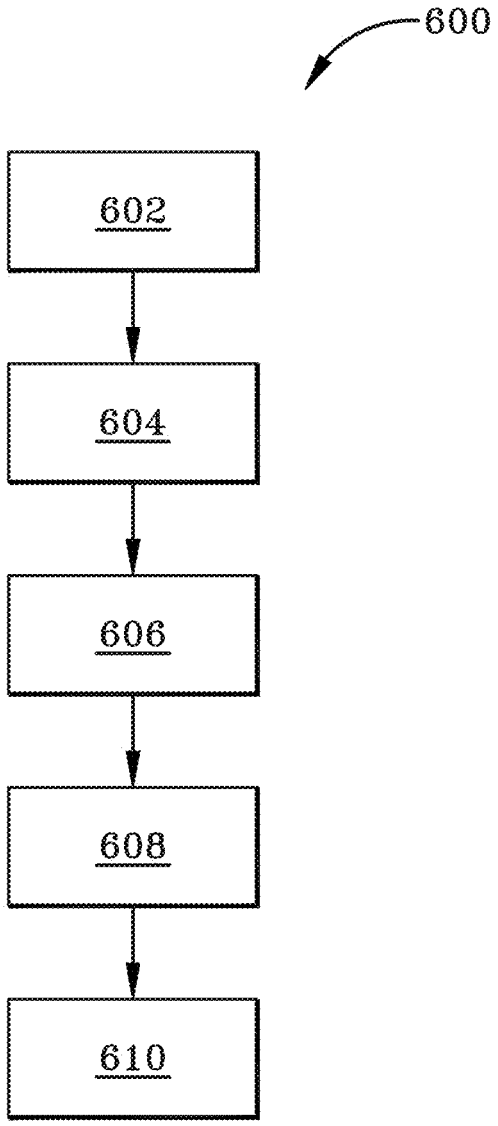
FIG. 6 is a flowchart for an exemplary method.

FIG. 6 relates to a method for manufacturing the chew 600. The method 600 comprising the steps of: measuring ingredients, including non-tobacco ingredients including plant material and a starch, a sweetener, natural and artificial flavors, a pH adjuster, water, salt, and optionally nicotine 602, adding said ingredients into a mixer 604, mixing said ingredients in the mixer 606, drying the mixed ingredients 608, and packaging the ingredients into a package 610.

Figure 7:
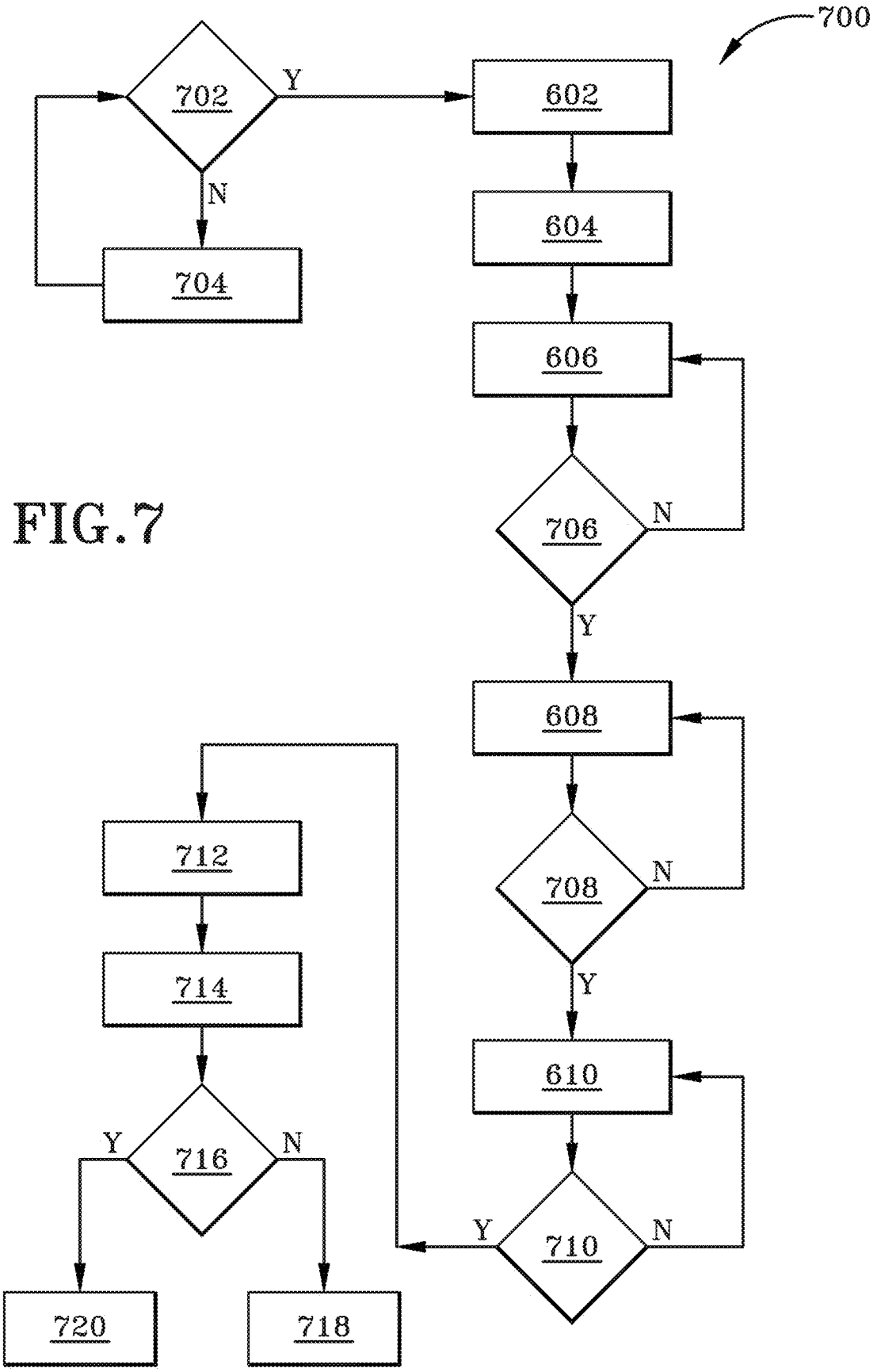
FIG. 7 is a flowchart for a further exemplary method.

FIG. 7 relates to an alternative embodiment of a method for manufacturing the chew 700. In some embodiments, prior to measuring the ingredients 702, it may be determined that the starch may need to be a proper color 702 i.e. dyed, in order to better mimic tobacco containing products. If this determination is that the color is not proper, the starch is dyed 704. For example, in an embodiment using arrowroot, before the arrowroot is mixed it with the rest of the ingredients, 1.75 oz of brown liqua-gel food coloring per pound of arrowroot is added to a mixer, it is mixed on low for 30 minutes. Then, it is placed in bins to dry for a minimum of 12 hours. If it is then the proper color, it is then measured out with the rest of the ingredients 602 and added to a mixer 604. Of course, this is but one embodiment and depending on the color of the resultant starch or modified starch this may or may not need to be done. Alternative embodiments may use different concentrations of dye and different colors to effectuate desired color of the end product.

In an alternative embodiment, after mixing of the ingredients 606, it is then determined if the ingredients are sufficiently mixed 706. If they are not, the ingredients are returned to the mixer 604 and mixed again 606. If they are sufficiently mixed, the now mixed ingredients are dried 608.

After drying 608, the mixed ingredients are tested to determine their moisture content 708. If the test is not within desired range, the mixed ingredients are returned to drying 608. If the moisture content of the mixed ingredients is within proper range, they are placed into packaging 610. In an exemplary embodiment, if it is not dry enough, the chew material is returned to be further dried. In an alternative embodiment, if it is too dry, it may be rewetted with additional solvent and returned to adequately dry a subsequent time.

As they are passed to packaging 610, they are weighed to determine the amount of product within the package 710. If the package is too heavy, it is returned to the start of the packaging step. If the package is within proper weight it is passed along to sealing 712.

After the package is sealed 712, it is placed in a refrigerated area 714, the purpose of which is described above. After the package has been in the refrigerated area for a requisite time, the package is checked for leaks 716. If the package shows any leak, seepage or otherwise failure, the package is discarded 718. If the package is substantially free of any leaks or seepage, it is able to be sold 720.

EXAMPLES

Exemplary embodiments of a chew product 54 utilizing principals described herein are further illustrated by the following examples which are set forth to illustrate the presently disclosed subject matter and are not to be construed as limiting. All percentages are a weight percentage of the total mixture.

Example 1—"Classic" Flavored Full Nicotine Chew

Approximately 29% of tobacco alternative plant materials including spearmint leaves 30 and dyed arrowroot powder 32 are added, along with about 23% sweetener in the form of molasses 34 and xylitol 28, about 21% flavorants in the form of various liquid and powder forms 18, 20, 38, about 22% water 36 added, about 0.7% plasticizer 42 in the form of propylene glycol, about 0.7% salt 26, 0.7% pH adjusters, including ammonium salt 22 and baking soda 24, and about 3.5% nicotine 40 is added to a mixer and mixed.

This example, as well as all of the remaining examples may be mixed, dried, and subsequently processed and packaged in any way consistent with the disclosure herein. The resultant chew has a texture and color substantially similar to tobacco containing chews.

Example 2—"Classic" Flavored Half Nicotine Chew

Approximately 29% of tobacco alternative plant materials including spearmint leaves 30 and dyed arrowroot powder 32 are added, along with about 23% sweetener in the form of molasses 34 and xylitol 28, about 21% flavorants in the form of various liquid and powder forms 18, 20, 38, about 22% water 36 added, about 2.1% plasticizer 42 in the form of propylene glycol, about 0.7% salt 26, 0.7% pH adjusters, including ammonium salt 22 and baking soda 24, and about 1.7% nicotine 40 is added to a mixer and mixed.

Example 3—"Classic" Flavored Nicotine-Free Chew

Approximately 28% of tobacco alternative plant materials including spearmint leaves 30 and dyed arrowroot powder 32 are added, along with about 22% sweetener in the form of molasses 34 and xylitol 28, about 22% flavorants in the form of various liquid and powder forms 18, 20, 38, about 21% water 36 added, about 5.4% plasticizer 42 in the form of propylene glycol, about 0.7% salt 26, 0.7% pH adjusters, including ammonium salt 22 and baking soda 24, and no nicotine is added, and the ingredients are mixed.

Example 4—Mint Flavored Full Nicotine Chew

Approximately 28% of tobacco alternative plant materials including spearmint leaves 30 and dyed arrowroot powder 32 are added, along with about 22% sweetener in the form of molasses 34 and xylitol 28, about 25% flavorants in the form of various liquid and powder forms 18, 20, 38, about 20% water 36 added, about 0.7% salt, 0.7% pH adjusters, including ammonium salt 22 and baking soda 24, and about 3.3% nicotine 40 is added to a mixer and mixed.

Example 5—Mint Flavored Half Nicotine Chew

Approximately 28% of tobacco alternative plant materials including spearmint leaves 30 and dyed arrowroot powder 32 are added, along with about 22% sweetener in the form of molasses 34, about 25% flavorants in the form of various liquid and powder forms 18, 20, 38, about 22% water 36 added, about 0.7% salt 26, 0.7% pH adjusters, including ammonium salt 22 and baking soda 24, and about 1.7% nicotine 40 is added to a mixer and mixed.

Example 6—Mint Flavored Nicotine-Free Chew

Approximately 28% of tobacco alternative plant materials including spearmint leaves 30 and dyed arrowroot powder 32 are added, along with about 22% sweetener in the form of molasses 34, about 25% flavorants in the form of various liquid and powder forms 18, 20, 38, about 21% water 36 added, about 3% plasticizer 42, in the form of propylene glycol, about 0.7% salt 26, and 0.7% pH adjusters, including ammonium salt 22 and baking soda 24, and no nicotine is added, and the ingredients are mixed.

Example 7—Wintergreen Flavored Full Nicotine Chew

Approximately 29% of tobacco alternative plant materials including spearmint leaves 30 and dyed arrowroot powder 32 are added, along with about 19% sweetener in the form of molasses 34, about 26% flavorants in the form of various liquid and powder forms 18, 20, 38, about 22% water 34 added, about 0.1% plasticizer 42 in the form of propylene glycol, about 0.7% 26 salt, 0.9% pH adjusters, including ammonium salt 22 and baking soda 24, and about 3.4% nicotine 40 is added to a mixer and mixed.

Example 8—Wintergreen Flavored Half Nicotine Chew

Approximately 29% of tobacco alternative plant materials including spearmint leaves 30 and dyed arrowroot powder 32 are added, along with about 19% sweetener in the form of molasses 34, about 26% flavorants in the form of various liquid and powder forms 18, 20, 38, about 21% water 36 added, about 1.8% plasticizer 42 in the form of propylene glycol, about 0.7% salt 26, 0.9% pH adjusters, including ammonium salt 22 and baking soda 24, and about 1.7% nicotine 40 is added to a mixer and mixed.

Example 9—Wintergreen Flavored Nicotine-Free Chew

Approximately 29% of tobacco alternative plant materials including spearmint leaves 30 and dyed arrowroot powder 32 are added, along with about 19% sweetener in the form of molasses 34, about 26% flavorants in the form of various liquid and powder forms 18, 20, 38, about 21% water 36 added, about 3.6% plasticizer 42, in the form of propylene glycol, about 0.7% salt 26, 0.9% pH adjusters, including ammonium salt 22 and baking soda 24, and no nicotine is added, and the ingredients are mixed.

Example 10—Cherry Flavored Full Nicotine Chew

Approximately 29% of tobacco alternative plant materials including spearmint leaves 30 and dyed arrowroot powder 32 are added, along with about 23% sweetener in the form of molasses 34 and xylitol 28, about 17% flavorants in the form of various liquid and powder forms 18, 20, 38, about 22% water 36 added, about 5% plasticizer 42, in the form of propylene glycol, about 0.7% salt 26, 0.7% pH adjusters, including ammonium salt 22 and baking soda 24, and about 3.5% nicotine 40 is added.

Example 11—Cherry Flavored Half Nicotine Chew

Approximately 29% of tobacco alternative plant materials including spearmint leaves 30 and dyed arrowroot powder 32 are added, along with about 25% sweetener in the form of molasses 34 and xylitol 28, about 18% flavorants in the form of various liquid and powder forms 18, 20, 38, about 21% water 36 added, about 4% plasticizer 42, in the form of propylene glycol, about 0.7% salt 26, 0.7% pH adjusters, including ammonium salt 22 and baking soda 24, and about 1.7% nicotine 40 is added.

Example 12—Cherry Flavored Nicotine-Free Chew

Approximately 29% of tobacco alternative plant materials including spearmint leaves 30 and dyed arrowroot powder 32 are added, along with about 25% sweetener in the form of molasses 34 and xylitol 28, about 18% flavorants in the form of various liquid and powder forms 18, 20, 38, about 21% water 36 added, about 6% plasticizer 42, in the form of propylene glycol, about 0.7% salt 26, 0.7% pH adjusters, including ammonium salt 22 and baking soda 24, and no nicotine is added, and the ingredients are mixed.

Example 13—Peach Flavored Full Nicotine Chew

Approximately 27% of tobacco alternative plant materials including spearmint leaves 30 and dyed arrowroot powder 32 are added, along with about 21% sweetener in the form of molasses 34, about 26% flavorants in the form of various liquid and powder forms 18, 20, 38, about 21% water added, about 0.7% salt 26, 0.7% pH adjusters, including ammonium salt 22 and baking soda 24, and 3.2% nicotine 40 is added and the ingredients are mixed in a mixer.

Example 14—Berry Flavored Full Nicotine Chew

Approximately 27% of tobacco alternative plant materials including spearmint leaves 30 and dyed arrowroot powder 34 are added, along with about 21% sweetener in the form of molasses 34, about 26% flavorants in the form of various liquid and powder forms 18, 20, 38, about 21% water 36 added, about 0.7% salt 26, 0.7% pH adjusters, including ammonium salt 22 and baking soda 24, and 3.2% nicotine 40 is added.

Example 15—Bourbon Flavored Full Nicotine Chew

Approximately 29% of tobacco alternative plant materials including spearmint leaves 30 and dyed arrowroot powder 32 are added, along with about 22% sweetener in the form of molasses 34, about 21% flavorants in the form of various liquid and powder forms 18, 20, 38, about 24% water 36 added, about 0.7% salt 26, 0.7% pH adjusters, including ammonium salt 22 and baking soda 24, and 3.4% nicotine 40 is added, and the ingredients are mixed.

Also, various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral" and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, any method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed:

1. A method of making a tobacco-free chew composition comprising:

measuring ingredients, including a non-tobacco leaf material, a flavorant, and synthetic nicotine that is not derived from tobacco;

adding said ingredients into a mixer;

mixing said ingredients in the mixer;

drying the mixed ingredients;

packaging the ingredients into a package;

wherein prior to measuring the ingredients includes:

dyeing a starch material with a dye; wherein the dyeing the starch material further comprises:

weighing the starch material;

calculating out a colored dye at a concentration of about 1.75 oz per pound of starch material;

adding the dye to the starch material; and mixing the starch material in a mixer.

2. The method of claim 1, and prior to measuring comprising:

diluting the synthetic nicotine with a dilutant, wherein a ratio of the dilutant to the synthetic nicotine in a range from about 2:1 to about 4:1.

3. The method of claim 1, wherein the ingredients include wet and dry ingredients and adding of the ingredients includes:

adding half of the wet ingredients to the mixer;

adding half of the dry ingredients to the mixer;

adding the remaining half of the wet ingredients to the mixer; and adding the remaining half of the dry ingredients to the mixer.

4. The method of claim 1, wherein prior to drying the mixed ingredients occurs, the method includes:

determining if the ingredients are sufficiently mixed wherein, if the ingredients are sufficiently mixed, then they are passed to drying and if the ingredients are not sufficiently mixed, then they are returned to the mixer and mixed for an additional time.

5. The method of claim 1, wherein prior to packaging the ingredients occurs, the method includes:

weighing the mixed ingredients after drying to determine moisture content;

determining if the mixed ingredients are at the proper moisture content;

redrying the mixed ingredients if the mixed ingredients are not at the proper moisture content for an additional time; and passing the mixed ingredients on to packaging if they are sufficiently dry.

6. The method of claim 1, wherein packaging the ingredients includes:

filling the package, weighing the package, determining proper package weight, returning the package to for more mixed ingredients to be added if the package is below proper weight, sealing the package if it is at the proper weight.

7. The method of claim 6, and subsequent to packaging comprising:

refrigerating the package.

8. The method of claim 7, and subsequent to refrigerating the package and further comprising:

checking the package for any leaks;

discarding the package if it has the presence of any leaks; and preparing to sell the package if it is substantially free of any leaks.

* * * * *